US008938192B2

(12) United States Patent
Naitoh et al.

(10) Patent No.: US 8,938,192 B2
(45) Date of Patent: Jan. 20, 2015

(54) FIXING DEVICE HAVING PIPE HEATER AND IMAGE FORMING APPARATUS WITH FIXING DEVICE

(75) Inventors: Yutaka Naitoh, Hyogo (JP); Shigeo Nanno, Kyoto (JP); Tomohiko Fujii, Hyogo (JP); Minoru Toyoda, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 227 days.

(21) Appl. No.: 13/445,390

(22) Filed: Apr. 12, 2012

(65) Prior Publication Data

US 2012/0275834 A1 Nov. 1, 2012

(30) Foreign Application Priority Data

Apr. 28, 2011 (JP) ..... 2011-100529

(51) Int. Cl.
*G03G 15/20* (2006.01)

(52) U.S. Cl.
CPC ..... *G03G 15/2053* (2013.01); *G03G 15/2064* (2013.01); *G03G 2215/2035* (2013.01)
USPC ..... 399/329

(58) Field of Classification Search
CPC ..... G03G 15/2053; G03G 15/2064
USPC ..... 399/329
See application file for complete search history.

(56) References Cited

U.S. PATENT DOCUMENTS 7,377,446 B2 * 5/2008 Ohta et al. ..... 235/492
7,769,332 B2 8/2010 Yamamoto et al.
7,881,635 B2 2/2011 Yamazoe et al.
7,890,017 B2 2/2011 Naitoh et al.
8,095,041 B2 1/2012 Nanno et al.
8,107,864 B2 1/2012 Saito et al.
2009/0010680 A1 1/2009 Nanno (Continued)

FOREIGN PATENT DOCUMENTS

CN 101183235 A 5/2008
CN 101403884 A 4/2009

(Continued)

OTHER PUBLICATIONS

U.S. Appl. No. 13/346,061, filed Jan. 9, 2012, Shigeo Nanno, et al.

(Continued)

*Primary Examiner* — Walter L Lindsay, Jr.
*Assistant Examiner* — Philip Marcus T Fadul
(74) *Attorney, Agent, or Firm* — Oblon, Spivak, McClelland, Maier & Neustadt, L.L.P.

(57) ABSTRACT

A fixing device comprises a flexible endless belt rotated in a prescribed direction to heat and fuse a toner image, a rotating member disposed on an outer circumferential surface side of the flexible endless belt that presses against and rotates the flexible endless belt, and a fixed member fixedly mounted on the fixing device at both lateral ends and disposed on an inner circumferential surface side of the flexible endless belt to press against the rotating member via the flexible endless belt. A heater is fixedly disposed facing an inner circumferential surface of the flexible endless belt to heat the flexible endless belt. The heater includes an opening opposed to the rotating member that accommodates the fixed member. A reinforcing member is fixedly disposed on an inner circumferential surface side of the heater to contact and reinforce the fixed member.

25 Claims, 4 Drawing Sheets

(56) References Cited

U.S. PATENT DOCUMENTS

| | | | | |
|---|---|---|---|---|
| 2009/0129836 | A1 | 5/2009 | Sakaya et al. | |
| 2009/0162772 | A1 | 6/2009 | Fuwa et al. | |
| 2010/0034548 | A1 | 2/2010 | Naitoh et al. | |
| 2010/0232848 | A1 | 9/2010 | Naitoh | |
| 2011/0008082 | A1 | 1/2011 | Nanno | |
| 2011/0026944 | A1 | 2/2011 | Naitoh | |
| 2011/0064443 | A1* | 3/2011 | Iwaya et al. | 399/69 |
| 2011/0142495 | A1 | 6/2011 | Nanno | |
| 2011/0222875 | A1* | 9/2011 | Imada et al. | 399/33 |
| 2012/0020681 | A1 | 1/2012 | Naitoh et al. | |

FOREIGN PATENT DOCUMENTS

| | | |
|---|---|---|
| JP | 2008-146010 | 6/2008 |
| JP | 2010-96782 | 4/2010 |

OTHER PUBLICATIONS

Chinese Office Action issued May 29, 2014, in China Patent Application No. 201210114258.5.

* cited by examiner

FIXING DEVICE HAVING PIPE HEATER AND IMAGE FORMING APPARATUS WITH FIXING DEVICE

CROSS-REFERENCE TO RELATED APPLICATION

This patent application is based on and claims priority pursuant to 35 U.S.C. §119 to Japanese Patent Application No. 2011-100529, filed on Apr. 28, 2011 in the Japan Patent Office, the entire disclosure of which is hereby incorporated by reference herein.

BACKGROUND OF THE INVENTION

1. Field of the Invention

The present invention relates to an image forming apparatus such as a copier, printer, facsimile machine, or multifunction device (MFD) combining several of these capabilities, and more particularly, to a fixing device employed in such an image forming apparatus.

2. Discussion of the Background Art

A fixing device installed in an image forming apparatus such as a copier, a printer, etc., is known that employs a pipe-shaped heating member made of heat conductive metal disposed opposite an inner circumferential surface of an endless fixing belt (i.e., a fixing member) and around which the fixing belt slides as it is rotated, as described, for example, in Japanese Patent Application Publication No. 2010-96782 (JP-2010-96782-A). Specifically, the pipe-shaped heater itself is heated by a heat source to heat the entire endless fixing belt to reduce defective fixing, even in a configuration in which a warm-up time and a first printing time are minimized to speed up operation of the image forming apparatus.

The fixing device of JP-2010-96782-A is composed of the endless belt, a fixed member fixedly disposed on an inner circumferential surface side of the endless fixing belt while pressing against a rotating member via the endless fixing belt and forming a nip thereon, and the pipe-shaped heating member fixedly disposed on the inner circumferential surface side of the endless fixing belt having an opening (i.e., a concave portion) opposed to the rotating member (i.e., via the nip). Also included in the fixing device of JP-2010-96782-A is a heater located inside the pipe-shaped heater and a reinforcing member to reinforce the fixed member. Hence, when a toner image borne on a recording medium is transported to the nip, it is fixed thereon under heat and pressure at the nip.

JP-2010-96782-A further discloses a technology of using a pair of stay bolts as a holder to hold and maintain a shape of the pipe-shaped heater near the opening to prevent the opening from expanding near the nip due to the spring-back tendency of the metal from which the heating member is formed.

However, although occurrence of the problem caused by deformation of the pipe-shaped heating member can be successfully prevented by use of such a holder, the number of component parts increases, thereby complicating assembly and somewhat limiting the range of design choices.

BRIEF SUMMARY OF THE INVENTION

Accordingly, the present invention provides a novel fixing device that comprises a flexible endless belt that is rotated in a prescribed direction to heat and fuse a toner image, a rotating member disposed on an outer circumferential surface side of the endless belt that presses against and rotates the endless belt, and a fixed member fixedly mounted on the fixing device at both lateral ends and disposed on an inner circumferential surface side of the endless belt to press against the rotating member via the endless belt and forming a nip on the endless belt. A heater is fixedly disposed facing an inner circumferential surface of the endless belt to heat the endless belt. The heater includes an opening opposed to the rotating member to accept the fixed member. A reinforcing member is fixedly disposed on an inner circumferential surface side of the heater to contact and reinforce the fixed member. The fixed member holds an opening edge of the heater to prevent the heater from deforming.

In another aspect of the present invention, the heater is mainly composed of a pipe manufactured using a bending process. The pipe has bent portions rising up from its both lengthwise ends toward an interior of the pipe at the opening. The fixed member includes a groove to receive the bent portions of the pipe.

In yet another aspect of the present invention, a sheet like member made of low friction material is provided intervening between the endless belt and the fixed member. The sheet like member is held substantially sandwiched between the bent portion of the pipe and the groove of the fixed member.

In yet another aspect of the present invention, lubricant having a worked penetration of more than about 300 degrees is used intervening between the sheet like member and the endless belt.

In yet another aspect of the present invention, the reinforcing member is mainly composed of a plate extending in a prescribed direction in which the rotating member presses against the endless belt. The plate fits into a concave portion formed in the fixed member. A length of the reinforcing member is more than about 80% of a diameter of the heater in the prescribed direction.

In yet another aspect of the present invention, the reinforcing member is made of material having a Vickers hardness of more than about 200 degrees.

In yet another aspect of the present invention, the reinforcing member is made of ferritic stainless steel or ceramic.

In yet another aspect of the present invention, the fixed member includes a main portion made of heat-resistant plastic and an elastic portion made of elastic material located opposite the rotating member.

In yet another aspect of the present invention, an image formation apparatus includes a fixing device. The fixing device comprises a flexible endless belt that travels in a prescribed direction to heat and fuse a toner image, a rotating member disposed on an outer circumferential surface side of the endless belt to rotate pressing against the endless belt, and a fixed member fixedly disposed on an inner circumferential surface side of the endless belt to press against the rotating member via the endless belt forming a nip on the endless belt. A heater is fixedly disposed along an inner circumferential surface of the endless belt to face and heat the endless belt. The heater includes an opening opposed to the rotating member to accept the fixed member. A reinforcing member is fixedly disposed on an inner circumferential surface side of the heater to contact and reinforce the fixed member. The fixed member holds an opening edge of the heater not to deform or change a cross-sectional shape of the heater near the opening.

BRIEF DESCRIPTION OF THE DRAWINGS

A more complete appreciation of the present invention and many of the attendant advantages thereof will be more readily obtained as the same becomes better understood by reference to the following detailed description when considered in connection with the accompanying drawings, wherein.

DETAILED DESCRIPTION OF THE INVENTION

Figure 1:
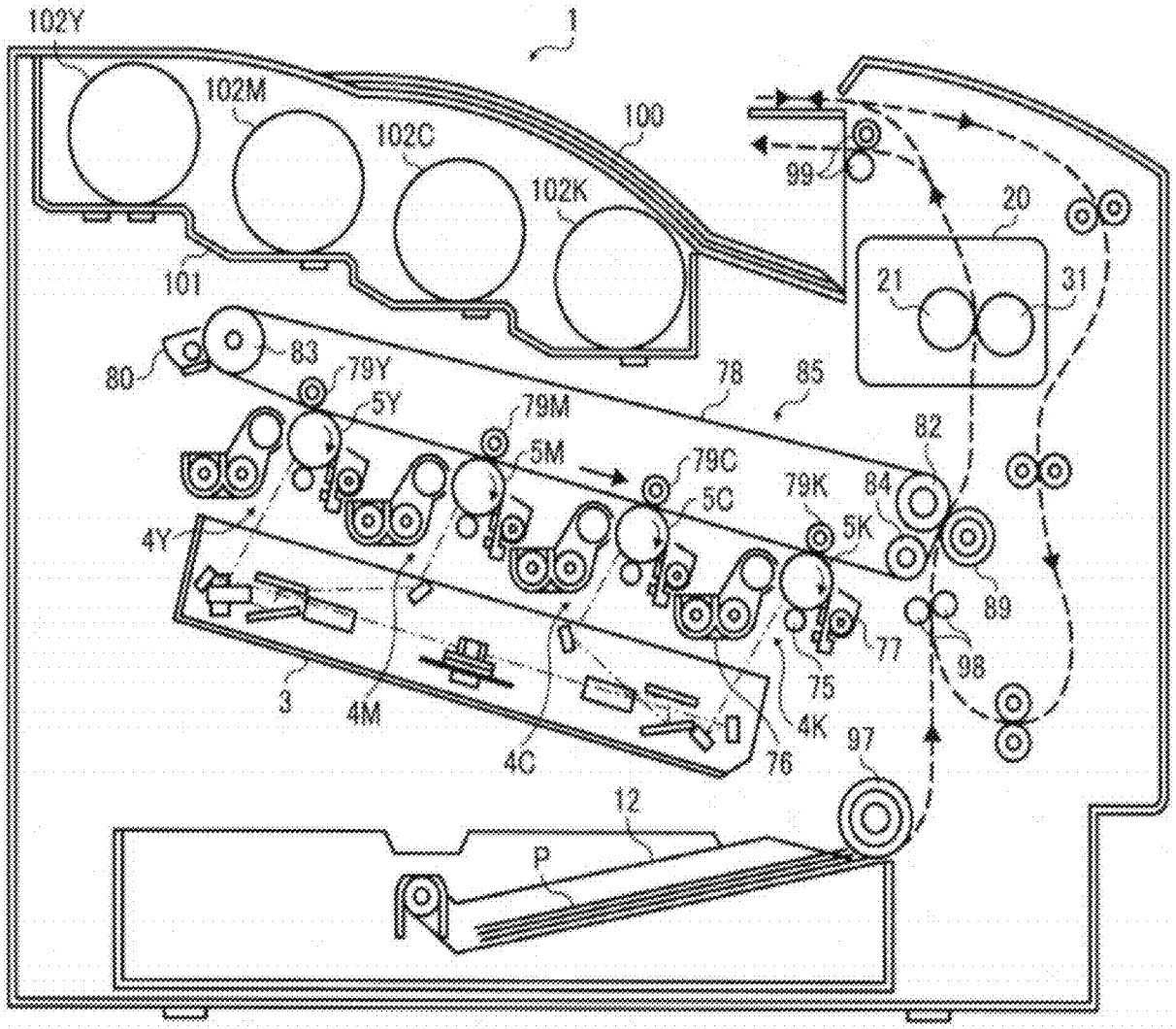
FIG. 1 is a diagram illustrating an overall image forming apparatus according to one embodiment of the present invention.

Referring now to the drawings, wherein like reference numerals designate identical or corresponding parts throughout the several views thereof and in particular to FIG. 1, a configuration and an operation of an overall image forming apparatus are initially described. As shown there, an image formation apparatus 1 of this embodiment is a tandem-type color printer. Specifically, four toner bottles 102Y, 102M, 102C, and 102K are detachably attached (i.e. replaceable) to a toner bottle container 100 disposed on a main body of the image formation apparatus 1 of respective colors of yellow, magenta, cyan, and black. Below the bottle container 100, an intermediate transfer unit 85 mainly composed of an intermediate transfer endless belt 78 is disposed. Multiple image formation units 4Y, 4M, 4C, and 4K of respective colors of yellow, magenta, cyan, and black are disposed opposite the intermediate transfer endless belt 78 of the intermediate transfer unit 85.

Multiple photoconductive drums 5Y, 5M, 5C, and 5K are arranged in the image formation units 4Y, 4M, 4C, and 4K, respectively. Further, around each photoconductive drum, 5Y, 5M, 5C, and 5K, there are provided a charge unit 75, a development unit 76, a cleaning unit 77, and a charge removing unit 4 (not shown) or the like. Thus, on each of the photoreceptor drums 5Y, 5M, 5C, and 5K, each color image is formed when an image formation process of a charging process, an exposure process, a development process, a transfer process, and a cleaning process are executed.

The photoconductive drums 5Y, 5M, 5C, and 5K are driven clockwise as shown in FIG. 1 by a drive motor, not shown there. Subsequently, at respective positions of the charge units 75, surfaces of the photoconductive drums 5Y, 5M, 5C, and 5K are uniformly charged (in the charging process), respectively. After that, the surfaces of the photoconductive drums 5Y, 5M, 5C, and 5K reach irradiation positions to which laser light fluxes L are emitted from the exposure unit 3, and thereby electrostatic latent images corresponding to colors are formed when exposure scanning is executed there (in the exposure process), respectively.

The surfaces of the photoconductive drums 5Y, 5M, 5C, and 5K reach positions opposite the development units 76, and the latent electrostatic images are developed in these positions forming toner images of respective colors (in the development process). The surfaces of the photoconductive drums 5Y, 5M, 5C, and 5K then reach positions opposite the intermediate transfer endless belt 78 and primary transfer bias rollers 79Y, 79M, 79C, and 79K, so that the toner images are transferred onto the intermediate transfer endless belt 78 there (in a primary transfer process), respectively. At that moment, not transferred toner particles remains on the photoreceptor drums 5Y, 5M, 5C, and 5K, respectively.

Then, these surfaces of the photoconductive drums 5Y, 5M, 5C, and 5K reach positions opposite the cleaning units 77, and the not transferred toner particles slightly remaining on the photoreceptor drums 5Y, 5M, 5C, and 5K are mechanically removed therefrom by cleaning blades (in the cleaning process), respectively. Finally, the surfaces of the photoconductive drums 5Y, 5M, 5C, and 5K reach positions opposite the charge removing units, not shown, and residual potential on the respective photoreceptor drum 5Y, 5M, 5C, and 5K are removed therefrom at these positions. Hence, a series of image processes done on each of the photoconductive drums 5Y, 5M, 5C, and 5K is completed.

Subsequently, a toner image of each color formed in the development process on each photoconductive drum is transferred and superimposed on the intermediate transfer endless belt 78. Hence, the color image is formed on the intermediate transfer endless belt 78. Here, the intermediate transfer unit 85 is mainly composed of the intermediate transfer endless belt 78, four intermediate transfer bias rollers 79Y, 79M, 79C, and 79K, four secondary transferal backup rollers 82, four cleaning backup rollers 83, four tension rollers 84, and an intermediate transfer cleaning unit 80 or the like. The intermediate transfer endless belt 78 is stretched and supported by three rollers 82 to 84, and is endlessly rotated by rotation driving of one of the rollers 82 to 84 in a direction shown by arrow in FIG. 1.

Each of the four primary transfer bias rollers 79Y, 79M, 79C, and 79K, sandwiches the intermediate transfer endless belt 78 with each of the photoconductive drums 5Y, 5M, 5C, and 5K forming a primary transfer nip therebetween. Subsequently, a transfer bias with reverse polarity to that of toner is applied to each of the primary transfer bias rollers 79Y, 79M, 79C, and 79K. Subsequently, the intermediate transfer endless belt 78 travels in a direction shown by arrow and sequentially passes through each of the primary transfer nips on the primary transfer bias rollers 79Y, 79M, 79C, and 79K. Hence, each of the color toner images on the photoreceptor drums 5Y, 5M, 5C, and 5K is transferred and superimposed on the intermediate transfer endless belt 78.

Subsequently, the intermediate transfer endless belt 78 on which the color toner images are transferred and superimposed reaches a position opposite a secondary transfer roller 89. At that position, the secondary transfer backup roller 82 sandwiches the intermediate transfer endless belt 78 with the secondary transfer roller 89 forming a second transfer nip therebetween. Subsequently, a four color toner image formed and borne on the intermediate transfer endless belt 78 is transferred onto a recording medium P transported to the secondary transfer nip position. At that time, toner not transferred onto the recording medium P remains on the intermediate transfer endless belt 78. In any case, the intermediate transfer endless belt 78 then reaches a position of the intermediate transfer cleaning unit 80. Accordingly, the not transferred toner borne on the intermediate transfer endless belt 78 is collected at that position. Hence, a series of transfer process executed on the intermediate transfer endless belt 78 terminates.

Here, the recording medium P located at the position of the secondary transferal nip comes from the sheet feeding unit 2 being transported via a sheet feed roller 97 and a registration roller 98 or the like disposed in a lower section of the apparatus main body. Specifically, multiple numbers of recording media P, such as transfer sheets, etc. are accommodated and stacked on the sheet feeding unit 12. When the sheet-feed roller 97 is driven and rotated counter clockwise in FIG. 1, the top-most recording medium P thereon starts being fed toward the pair of registration rollers 98.

The recording medium P transported to the pair of registration rollers 98 stops advancing at a roller nip formed between the pair of registration rollers 98 when they stop their rotation-driving. Subsequently, in synchronism with traveling of the color image borne on the intermediate transfer endless belt 78, the pair of registration rollers 98 starts being driven and rotating, and accordingly the recording medium P is conveyed toward the secondary transfer nip. Hence, a desired color image is transferred onto the recording medium P.

After that, the recording medium P, on which a color image is transferred at the secondary transfer nip, is further conveyed to a position of the fixing device 20. Subsequently, at that position, the color image transferred onto the surface of the recording medium P is fused thereon by pressure and heat provided from the endless fixing belt 21 and the pressing rollers 31, respectively. Subsequently, the recording medium P is ejected outside the apparatus 1 between a pair of exit rollers 99 through a gap therebetween. The recording medium P ejected outside the apparatus 1 by the pair of exit rollers 99 is then stacked sequentially on a stack unit 100 as an output image to complete a single image formation process.

Figure 2:
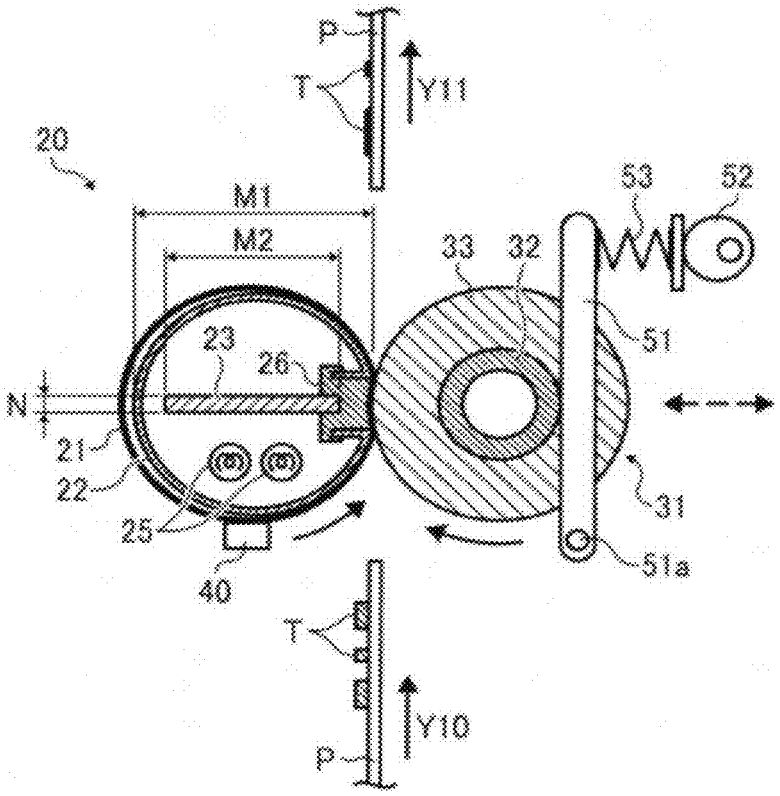
FIG. 2 is a vertical cross-sectional diagram illustrating a fixing device employed in the image forming apparatus shown in FIG. 1.
Figure 3:
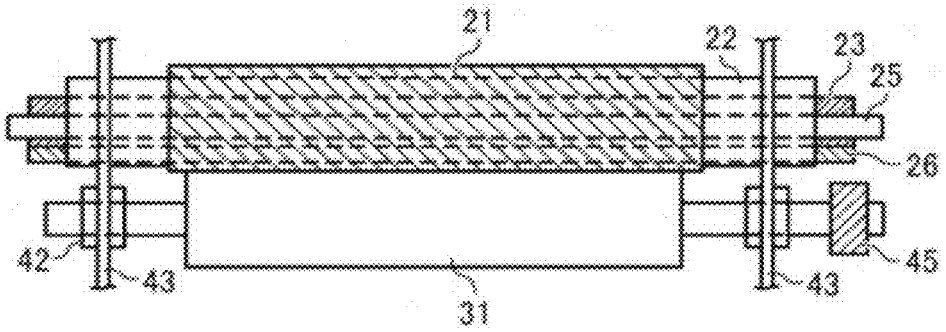
FIG. 3 illustrates a horizontal view of the fixing device.
Figure 4:
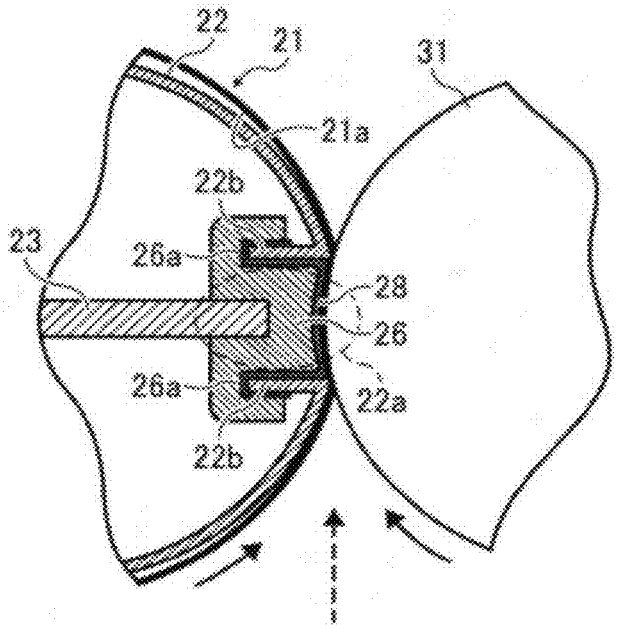
FIG. 4 is an enlarged view illustrating the vicinity of a fixing nip.
Figure 5:
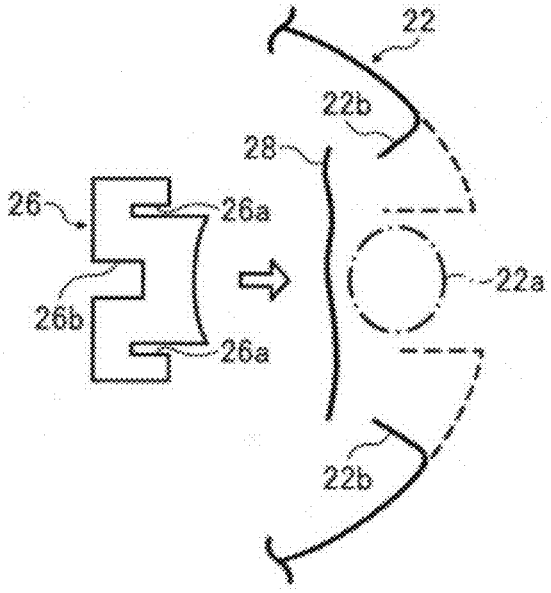
FIG. 5 is a schematic diagram illustrating a state in which a fixed member and a sheet are assembled into a heater.

Now, a configuration and a behavior of a fixing device 20 located within a main body of the image formation apparatus 1 are described with reference to FIGS. 2 to 5. In particular, FIG. 2 is a diagram illustrating a fixing device 20. FIG. 3 is diagram illustrating the fixing device 20 when viewed in a widthwise direction. FIG. 4 is an enlarged view of a vicinity of a nip of the fixing device 20. FIG. 5 is a schematic diagram that shows a state in which a fixed member 26 and a sheet like member are integrated with a heater 22. As shown in FIGS. 2 and 4, a fixing device 20 is mainly composed of an endless fixing belt 21, a fixed member 26, and a heater 22. The fixing device 20 is also composed of a reinforcing member 23 (i.e., a supporter), a heat source 25, a sheet 28, and a pressure roller 31 as a rotating member. The fixing device 20 is further composed of a temperature sensor 40 and contact/separation mechanisms 51 to 53.

Here, the endless fixing belt 21 is a flexible thin-walled endless-type belt, and rotates counter-clockwise as shown by arrow in FIG. 2. The endless fixing belt 21 is formed from a substrate layer, an elastic layer, and a mold releasing layer stacked sequentially from a side of an inner surface 21*a* (i.e., a sliding surface that contacts the fixed member 26), and having a combined thickness of less than about 1 mm. The substrate layer of the endless fixing belt 21 has a thickness of from about 30 μm to about 100 μm, and the substrate layer itself is made of metal, such as nickel, stainless steel, or resin, such as polyimide, etc. A thickness of the elastic layer of the endless fixing belt 21 is from about 100 μm to about 300 μm, and is made of rubber, such as silicone rubber, foam-silicone rubber, fluorine rubber, etc. With the elastic layer, since fine surface unevenness is no longer formed on the endless fixing belt 21 at the nip thereof, heat is uniformly transmitted to a toner image borne on a recording medium P, and accordingly a so-called orange skin image rarely occurs. The mold-releasing layer of the endless fixing belt 21 has a thickness of from about 10 μm to about 50 μm, and is made of PFA (tetrafluoroethylene-perfluoroalkyl vinyl ether copolymer), PTFE (polytetra-fluoroethylene), polyimide, polyether imide, and PES (polyether sulfide) or the other material. With the mold-releasing layer, a mold releasing performance for toner T (a toner image) can be obtained.

Further, a diameter of the endless fixing belt 21 in its operational lo26Boped shape is from about 15 mm to about 120 mm. In this embodiment, the diameter of the endless fixing belt 21 in its operational looped shape is about 30 mm. As shown in FIGS. 2 and 4, in the interior (an inner surface side) of the endless fixing belt 21, a sheet 28, a fixed member 26, a heat source 25 (a heating device), a heater 22, a reinforcing member 23, etc. are fixedly disposed. Specifically, the fixed member 26 is secured to contact the inner circumferential surface of the endless belt 21 via the sheet 28 as the endless belt 21 slides over the fixed member 26. Thus, with the fixed member 26 pressing and contacting the pressure roller 31 through the endless fixing belt 21, a nip, to which and through which a recording medium P is conveyed, is formed. As shown in FIG. 3, widthwise ends of the fixed member 26 are firmly supported by a pair of side plates 43 of the fixing device 20, respectively. More specifically, the fixed member 26 is held by the side plates 43 via flanges, etc., not shown, respectively, not to move left and right sides in FIG. 3, and able to vertically move (a pressure contacting direction) by only a small amount together with the reinforcing member 23. Further, a configuration and a behavior of the fixed member 26 is described later more in detail.

As shown in FIGS. 2 and 4, the heater 22 is mainly composed of a pipe having a wall thickness of about 0.1 mm. The heater 22 is disposed directly facing the overall inner circumferential surface of the endless fixing belt 21 except for the nip, where an opening is formed in the pipe heater 22. Further, the fixed member 26 is disposed at the position of the opening 22*a* of the heater 22. As shown in FIG. 3, both ends of the heater 22 in the widthwise direction are firmly supported by the pair of side plates 43 of the fixing device 20. Further, the heater 22 is heated by radiant heat (i.e., radiant light) generated by the heat source 25 that then heats the endless fixing belt 21. That is, the heater 22 is directly heated by the heat source 25 (i.e., a heating device), so that the endless fixing belt 21 is heated by the heat source 25 indirectly via the heater 22. As material of the heater 22, metal thermal conductor, such as aluminum, iron, stainless steel, etc., (i.e., heat conductive metal) can be used. With the heater 22 having a thickness of less than about 0.2 mm, heating effectiveness of heating the endless fixing belt 21 (and the heater 22) can be improved. In this embodiment, the heater 22 is made of stainless steel having a wall thickness of about 0.1 mm.

The heat source 25 (a heat source unit) is composed of a halogen heater or a carbon heater, firmly supported at both ends by the pair of side plates 43 of the fixing device 20, respectively (as shown in FIG. 3). Further, an output of the heat source 25 is controlled by a power supply of the apparatus main body 1 when heating the heater 22 with the radiant heat. Further, the overall endless fixing belt 21 is heated by the heater 22 except for the nip portion, and ultimately heats the toner image T borne on the recording medium P on the surface of the endless fixing belt 21. The output of the heat source 25 is controlled based on a result of detection of surface temperature of the endless fixing belt 21 by a temperature sensor 40, such as a thermistor, etc., disposed opposite the surface of the endless fixing belt 21. Further, temperature of the endless fixing belt 21 (i.e. a fixing temperature) can be controlled at a desired level by controlling the output of such heat source 25.

Hence, since almost the entire endless fixing belt 21 is heated in a circumferential direction by the heater 22, and the endless fixing belt 21 is not partially heated in the fixing device 20 of this embodiment, the endless fixing belt 21 can be sufficiently heated while reducing occurrence of defective fixing, even when the apparatus 1 is operated at high speed. Specifically, since the endless fixing belt 21 can be effectively heated with a relatively simple configuration, the apparatus can be downsized while decreasing the warm-up time and the first print time.

Here, a gap 8(delta) formed between the endless fixing belt 21 and the heater 22 excluding the nip position is favorably greater than 0 mm and less than 1 mm (i.e. 0 mm<ϵ≤1 mm). This enables the heater 22 to slide on the endless fixing belt 21 in a large area and almost resolve a problem of accelerating wear of the endless fixing belt 21. At the same time, the heater 22 does not separate too far from the endless fixing belt 21 thereby suppressing occurrence of a problem of degrading heating effectiveness of the endless fixing belt 21. Further, since the heater 22 is disposed close to the endless fixing belt 21, and accordingly the flexible endless fixing belt 21 can maintain a circular posture by some degree, damage and degradation generally caused by deformation of the endless fixing belt 21 can be reduced. Further, to mitigate wear of the endless fixing belt 21 even if the endless fixing belt 21 (i.e. an endless belt unit) and the heater 22 contact and slide on each other, lubricant, such as fluorine grease, silicone oil, etc., is adequately coated therebetween. Otherwise, to reduce a frictional resistance between the heater 22 and the endless fixing belt 21, a sliding surface of the heater 22 can be made of low frictional coefficient material, or a surface layer made of material including fluorine or the like can be formed on the inner circumferential surface of the endless fixing belt 21. Further, instead of the circular cross-sectional shape as employed in the above-described embodiment, the heater 22 can employ a polygonal cross-sectional shape.

The reinforcing member 23 (e.g., a supporter) is provided to support and reinforce the fixed member 26 that forms the nip, and is fixedly disposed on the inner circumferential surface side of the endless fixing belt 21. As shown in FIG. 3, the reinforcing member 23 has a prescribed width substantially equal to that of the fixed member 26, and both ends thereof in its widthwise direction are again supported by respective of the pair of the side plates 43 of the fixing device 20. Further, with the reinforcing member 23 pressing against the pressure roller 31 (i.e., a rotating member) via the fixed member 26, the sheet 28, and the endless fixing belt 21, significant deformation of the fixed member 26 generally caused by pressure from the pressure roller 31 as a problem can be suppressed at the nip.

Further, the reinforcing member 23 is preferably made of material having high mechanical strength, such as metal (e.g., stainless steel or iron), ceramic, etc., to satisfy functions as described above. Further, a certain heat insulator can be provided over the whole or part of a surface of the reinforcing member 23 facing the heat source 25, or BA processing or specular polishing processing can be applied thereto. Hence, since heat emitted from the heat source 25 toward the reinforcing member 23 (i.e., heat heating the reinforcing member 23) is used for heating the heater 22, effectiveness of heating the endless fixing belt 21 (i.e., a heater 22) further increases. However, a configuration and an operation of the reinforcing member 23 are described more in detail later.

As shown in FIG. 2, the pressure roller 31 as a pressure rotator contacting an outer circumferential surface of the endless fixing belt 21 at the nip position has a diameter of about 30 mm, and is formed from a hollow-metal core 32 and an elastic layer 33 overlying thereon. The elastic layer 33 of the pressure roller 31 (i.e., a pressure rotator) is made of rubber, such as foam-silicone rubber, silicone rubber, fluorine rubber, etc. Furthermore, a thin mold releasing layer made of material, such as PFA, PTFE, etc., can be provided on a surface of the elastic layer 33. The pressure roller 31 presses against the endless fixing belt 21 to form a desired nip between both members. As shown in FIG. 3, a gear 45 is attached to the pressure roller 31 to mesh with a drive gear of a drive mechanism, not shown, so that the pressure roller 31 is driven and rotated in the direction shown by arrow (i.e., a clockwise direction) in FIG. 2. Further, the pressure roller 31 is freely rotatably supported by the pair of side plates 43 of the fixing device 20 at its both ends in the widthwise direction through bearings 42, respectively. Further, a heat source, such as a halogen heater, etc., can be provided in the pressure roller 31.

When the elastic layer 33 of the pressure roller 31 is made of spongy material, such as foam silicone rubber, etc., since pressure applied to the nip section is reduced, an amount of deflection of the fixed member 26 can be decreased. Further, since insulation performance of the pressure roller 31 is enhanced, and accordingly heat becomes difficult to move from the endless fixing belt 21 to the pressure roller 31, effectiveness of heating the endless fixing belt can be upgraded. Although a diameter of the endless fixing belt 21 is equivalent to that of the pressure roller 31 in this embodiment, the diameter of the endless fixing belt 21 can be smaller than that of the pressure rollers 31. In such a situation, since a curvature of endless fixing belt 21 is smaller than that of the pressure roller 31 at the nip section, a recording medium P dispatched from the nip becomes easily separated from the endless fixing belt 21. By contrast, the diameter of the endless fixing belt 21 can be greater than the diameter of the pressure rollers 31. However, regardless of a relation of the diameter between the endless fixing belt 21 and the pressure roller 31, the system is designed such that pressure of the pressure roller 31 does not impact on the heater 22.

As shown in FIG. 2, the fixing device 20 of this embodiment includes multiple connection away mechanisms 51 to 53 that contacts and separates the pressure roller 31 with and from the endless fixing belt 21. Specifically, each of the connection away mechanisms 51 to 53 is mainly composed of a pressure lever 51, an eccentric cam 52, and a pressure spring 53 or the like. The pressure lever 51 is freely swingable about a supporting axis 51*a* supported by the pair of side plates 43 of the fixing device 20 at its one end. A center of the pressure lever 51 contacts a bearing 43 attached to the pressure roller 31, which is movably held by an oblong hole, not shown, formed on the side plate 43. Further, a pressure spring 53 is connected to the other end of the pressure lever 51. Also, the eccentric cam 52 rotated by a drive motor, not shown, engages a retaining plate retaining the pressure spring 53. With rotation of the eccentric cam 52 in such a configuration, the pressure lever 51 swings around the supporting axis 51*a*, so that the pressure roller 31 moves in a direction shown by arrow indicated by a broken line as shown in FIG. 2. Specifically, the eccentric cam 52 takes a posture during a normal fixing process as shown in FIG. 2, so that the pressure roller 31 presses against the endless fixing belt 21 and forms a desired nip. Whereas during a process other than the normal fixing process (e.g. a jam sheet dealing time or a waiting time), the eccentric cam 52 rotates by the angle of 180 degrees in a rotation direction from the state as shown in FIG. 2, and accordingly the pressure roller 31 separates from the endless fixing belt 21 (i.e., a tension of the endless fixing belt 21 is decreased).

Now, a normal operation ordinarily executed by the above-described fixing device 20 is briefly described herein below. When a power switch provided in the apparatus main body 1 is turned on, power is supplied to the heat source 25, and accordingly the pressure roller 31 starts rotation-driving at the same time in a direction as shown by arrow in FIG. 2. Consequently, the endless fixing belt 21 is driven (i.e., rotated) in the direction shown by arrow in FIG. 2 due to friction force caused together with the pressure roller 31. Subsequently, the record medium P is fed from the sheet feeding unit 12, and bears an unfixed color image transferred thereon at a position of the secondary transfer roller 89. The recording medium P with the unfixed color image T (i.e., a toner image) is transported in a direction shown by arrow Y10 of FIG. 2 while being guided by a guide plate, not shown, toward the nip formed between the pressure roller 31 and the endless fixing belt 21 pressing against each other. Subsequently, the toner image T is fixed onto the surface of the recording medium P by pressure applied by the pressure roller 31 and the fixed member 26 reinforced by the reinforcing member 23 and heat provided by the endless fixing belt 21 heated by the heater 22 (i.e., the heat source 25). After that, the recording medium P is sent out from the nip, and is conveyed in the direction Y11 as shown by arrow.

Now, a unique configuration and operation of the fixing device 20 of the above-described embodiment is below described in detail. An opening 22*a* is formed on the heater 22 at a position opposite the pressure roller 31 (i.e. a pressure rotating member) as shown in FIG. 4. Further, the secured member 26 is enabled to maintain a shape (i.e. a posture) of the heater 22 in the vicinity of the opening 22*a* by preventing the heater 22 from being distorted. Specifically, the secured member 26 has a function to maintain a shape (i.e. posture) of the heater 22 in the vicinity of the opening 22*a* by preventing the heater 22 from its distortion in addition to that to form a desired nip on the fixing endless belt 21 by pressing against the pressure roller 31 via the fixing endless belt 21.

The heater 22 is produced in a pipe state almost having a C-letter shape on its cross section using a bending process. The heater 22 further includes the opening 22*a* into which the fixed member 26 is partially inserted. Further, bending portions 22*b* rising toward an interior of the heater 22 are formed at both ends of the opening 22*a* (i.e., both edges of the heater 22 in the circumferential direction). Whereas in the fixed member 26, a groove 26*b* into which the bending portion 22*b* of the heater 22 fits is formed. Consequently, both of the fixed member 26 and the heater 22 are assembled while the bending portion 22*b* of the heater 22 fits into the groove 26*a* of the fixed member 26. With this configuration, deformation of the heater 22 generally caused due to spring back (i.e., deformation of the opening 22 in a heater spreading direction) can be prevented, because the bending portions 22*b* formed near the opening 22*a* fit into the groove 26*a* of the fixed member 26, even when the spring back almost occurs in the heater 22 produced having the C-shaped cross section using the bending process. Consequently, a secondary problem, such as cutting, unusual sound, slipping on the endless fixing belt 21, etc., generally raised when the spring back occurs in the heater 22, and accordingly the endless fixing belt 21 partially intensively contacts the heater 22, can be resolved.

In this embodiment, the fixed member 26 is made of heat-resistant resin, such as liquid crystal polymer, etc., and has a concave on its side surface facing the pressure roller 31 almost parallel to a curvature of the pressure roller 31. Hence, since the recording medium P is sent out from the nip almost along the curvature of pressure roller 31, a problem in that the recording medium P sticks to the endless fixing belt 21 and does not separate therefrom after the fixing operation can be almost resolved. Although the fixed member 26 forming the nip has the concave portion in this embodiment, a plane shape can be employed therein. Specifically, the sliding surface of the fixed member 26 (i.e., a surface facing the pressure roller 31) can be formed in a plane shape. Hence, the shape of the nip becomes almost parallel to an image plane of the recording medium P, thereby capable of reducing a problem of wrinkle on the recording medium P. Further, since the curvature of the endless fixing belt 21 increases on the outlet side of the nip, the recording medium P can easily separate from the endless fixing belt 21 when it is sent out from the nip. Further, a shape of the sliding surface of the fixed member 26 can be continuously changed from flat to concave states in a conveyance direction. Consequently, adhesion of the endless fixing belt 21 to the recording media P increases and a fixing performance can be upgraded maintaining the above-described advantages obtained by the shape of the sliding surface.

Hence, the fixed member 26 of this embodiment has a function to hold the shape of the heater 22 near the opening 22*a* not to deform the heater 22 beside a function to press against the pressure roller 31 via the endless fixing belt 21 and form a desired nip. Accordingly, the number of parts of the entire unit is decreased and assembling performance can be upgraded in comparison with a system in which an independent, dedicated holder is used to hold the shape of the heater 22 near the opening 22*a* so as not to deform the heater 22.

Further, since the opening 22*a* of the heater 22 is closed by the fixed member 26 in such a configuration, occurrence of a problem in that foreign body enters the heater 22 via the opening 22*a* can be almost prevented. Especially, when lubricant provided between the heater 22 and the endless fixing belt 21 enters inside the heater 22 as foreign substance, sliding friction of both members 21 and 22 increases and quickens abrasion degradation due to lack of lubricant. Otherwise, lubricant already entered the heater 22 sticks to the heat source 25 and thereby degrading a function thereof or vaporizes as a problem. More especially, when fluorine grease with high penetration ability is used as lubricant, effect of closing the opening 22*a* with the fixed member 26 can be further enhanced.

To increase heating effectiveness of the heater 22 here, a wall thickness of the heater 22 is preferably less than 0.2 mm. As mentioned above, since the pipe-shaped heater 22 is produced by applying a bending process to a metal plate and the wall thickness thereof is accordingly thin, warm-up time can be reduced. However, since rigidity of the heater 22 itself decreases instead, the heater 22 either bends or deforms when the pressure roller 31 applies pressure thereto, because the heater 22 cannot withstand the pressure. Consequently, when the pipe-state heater 22 deforms, a prescribed nip width is not available, thereby causing a problem of degrading the fixing performance. By contrast, because the opening 22*a* is provided in this embodiment in such a manner that pressure of the pressure roller 31 hardly directly act on the thin heater 22, such a problem rarely occurs.

As shown in FIG. 4, a sheet 28 made of low-friction material having excellent heat and abrasion resistances is disposed between the fixed member 26 and the endless fixing belt 21 in the vicinity of the opening 22*a* of the heater 22. More specifically, the sheet 28 of this embodiment is made of porous fluoro-polymer resin having a thickness of less than about 1 mm, and both ends thereof are almost held being sandwiched between the groove 26*a* of the fixed member 26 and the bending portion 22*a* of the heater 22. Hence, by disposing the sheet 28 made of low-friction material between the fixed member 26 and the endless fixing belt 21, a sliding friction between both members 21 and 26 increases, and accordingly a problem of quick wearing and degradation of these members 21 and 26 can be resolved.

Further, lubricant, such as silicone oil, fluorine grease, etc., having worked penetration greater than 300 degrees intervenes between the endless fixing belt 21 and the sheet 28 in this embodiment. Specifically, the lubricant is soaked in the sliding surface (i.e., a surface contacting and sliding on the endless fixing belt 21) of the sheet member 28 mainly consisting of porous material. Hence, wearing degradation with the sheet 28 can be more likely effectively reduced. This is because, it has been realized through an experiment that the effect of reducing the wearing deterioration of the endless fixing belt 21 is likely obtained constantly when the lubricant having worked penetration greater than about 300 degrees is used regardless of elapse of time. The "mixture cone penetration" of the lubricant is a unit representing a hardness of the lubricant and increases in proportion to amount of oil-bearing component.

FIG. 5 is a schematic chart that illustrates an aspect when the fixed member 26 and the sheet 28 are assembled to the heater 22. Before that, a pipe-shaped heater 22 is produced by applying a bending process to a stainless steel plate easy to process having a thickness of about 0.1 mm. Even if it is tried to shape the stainless steel plate as shown by a dashed line in FIG. 5 by applying the bending process thereto, it is opened by spring back of the stainless steel plate due to its pipe shape as shown by a solid line in FIG. 5. However, by securing the L-shaped bending portion 22*b* with the fixed member 26 at the opening 22*a* of the heater 22, the heater 22 (shown by a broken line in FIG. 5) can be formed in a given shape. Specifically, the fixed member 26 is inserted from the inner circumferential surface side of the heater 22 almost sandwiching the sheet 28, so that the bending portion 22*b* fits into the groove of the fixed member 26.

As shown in FIGS. 4 and 5, a recess (i.e., a concave portion) 26*b* is formed in a surface other than the sliding contact surface of the fixed member 26 (i.e., a surface located opposite the sliding contact surface forming the nip), into which a tip of the reinforcing member 23 fits in this embodiment. The reinforcing member 23 has a plate like shape and is fixedly disposed on the side of an inner circumferential surface of the heater 22 extending in a pressure contact direction of the pressure roller 31 (i.e., a left and right direction in FIG. 2). The reinforcing member 23 thus contacts the fixed member 26 (i.e., a nip formation member) to reinforce and support thereof. To satisfy its functionality, the reinforcing member 23 is preferably made of material having a Vickers hardness of more than about 200 degrees. Specifically, ferritic stainless steel, such as SUS-430 (e.g. Vickers hardness is about 250 degrees), etc., and ceramic (e.g. Vickers hardness is more than about 1500 degrees) can be suitable for the reinforcing member 23.

According to this embodiment, to ensure strength of the reinforcing member 23 absolutely while avoiding side effect, the reinforcing member 23 has a prescribed length M2 more than 80% of an outer diameter M1 of the heater 22 in the pressure contact direction (i.e. $80 \leq M2/M1 \times 100 < 100$) as shown in FIG. 2.

That is, in the fixing device 20 of this embodiment, if an amount of deviation in nip width between a center and an end in a widthwise direction is too large, a locally defective image occurs. Specifically, glossy irregularity appears in an image corresponding to the wide nip portion after the fixing process due to excessive supplying of heat to an unfixed toner image. By contrast, since the unfixed toner image does not fully melt nor fuse onto the recording medium P due to an insufficient amount of heat in the narrow nip portion, image peeling occurs. When the nip-width deviation increases, conveying balance of the recording medium P becomes bad, and accordingly wrinkle likely occurs thereon. Therefore, to resolve these problems, it is needed to keep a deflection amount of each of the pressure roller 31 and the reinforcing member 23 to be less than a prescribed level so that the nip width in the widthwise direction does not excessively deviate. Through various simulations and experiments by the inventor of this application, it has been recognized that when a deflection amount of the reinforcing member 23 is reduced to be less than about 0.083 mm, the above-described problem almost does not occur. Whereas it is possible indeed to reduce the amount of deflection by increasing a thickness N of the reinforcing member 23 as shown in FIG. 2, thereby capable of ensuring strength thereof. However, a heat capacity of the reinforcing member 23 increases in accordance with the thickness N. The reinforcing member 23 is preferable if its cubic volume is as small as possible in view of heating effectiveness of the endless fixing belt 21. To minimize the cubic volume of the reinforcing member 23 ensuring the strength thereof, the thickness N of the reinforcing member 23 is made as thinner as possible, and it is effective if the length M2 of the reinforcing member 23 in the pressure contact direction (i.e., the left and right direction in FIG. 2) is increased in proportion thereto.

However, in the conventional fixing device (as shown in the JP-2010-96782-A), an opening is formed to arrange a fixed member on the heater, and a pair of stays are provided to sandwich and fix the opening not to open. Consequently, a freedom of a shape of the reinforcing member (especially, a length in the pressure contact direction) is largely restricted. Whereas in the fixing device 20 of this embodiment, since the fixed member 26 prohibits the heater 22 to open at the opening 22*a*, the pair of stays sandwiching the opening 22*a* are not needed, and accordingly the length M2 of reinforcing member 23 in the pressure contact direction can be designed longer.

Figure 6:
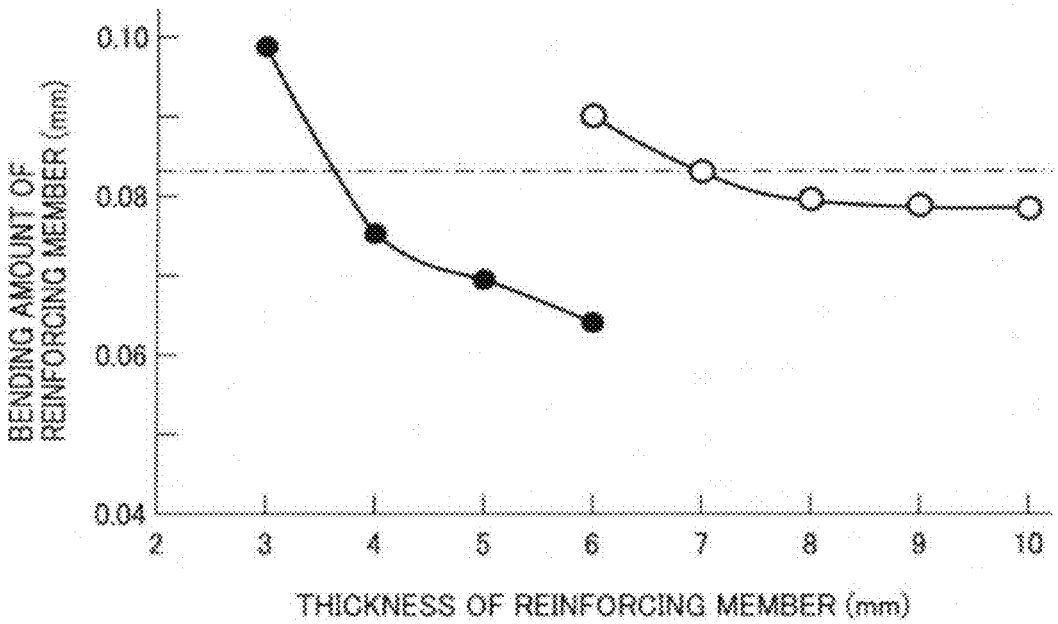
FIG. 6 is a graph illustrating a relation between a deflection amount and a thickness of a reinforcing member.

FIG. 6 is a graph that shows a relation between a thickness N (see, a lateral axis) of the reinforcing member 23 and an amount of deflection thereof (see a vertical axis). In the drawing, a mark "•" (dot) indicates the relation obtained in the fixing device of this embodiment. Whereas a mark "○" (circle) indicates the relation obtained in a conventional fixing device. It is understood from the drawing that a thickness of the reinforcing member needs more than about 7 mm in the conventional fixing device to keep a deflection amount to be less than about 0.083 mm, when a ratio of a length of the reinforcing member to an outside diameter of the heater is approximately 74.4% in the pressure contact direction, and the pressure roller 31 provides a load onto the nip. Whereas, in the fixing device 20 of this embodiment, it is understood that a thickness of the reinforcing member needs about 4 mm to keep a deflection amount to be less than about 0.083 mm, when a ratio of a length M2 of the reinforcing member 23 to an outside diameter M1 of the heater 22 is approximately 82.0% in the pressure contact direction, and the pressure roller 31 provides a load onto the nip. Hence, according to the fixing device 20 of this embodiment of the present invention, it is understood that sufficient strength of the reinforcing member 23 can be ensured even when a thickness of the reinforcing member 23 is significantly reduced.

Further, to ensure the strength capable of withstanding large load within a limited inner space of the heater 22, a reinforcing member 23 cannot be made of material having a Vickers hardness of less than about 200 degrees. Hence, the reinforcing member 23 is made of ferritic stainless steel, such as SUS-430, and ceramic according to this embodiment. When it is made of such SUS-430, the reinforcing member 23 can be relatively cheaply obtained. Further, the reinforcing member 23 can be also formed by overlaying multiple thin plates of general material made of SUS-430. Especially, by shaping a thin plate using a pressing process and integrating multiple thin plates using a prescribed securing method, such as spot welding, etc., thereby producing a reinforcing member 23, a cost of parts more decreases. When the reinforcing member 23 is made of such ceramic, since a heat capacity of the reinforcing member 23 itself can be more reduced while ensuring the great mechanical strength, heating of the endless fixing belt 21 can be more effective.

Figure 7:
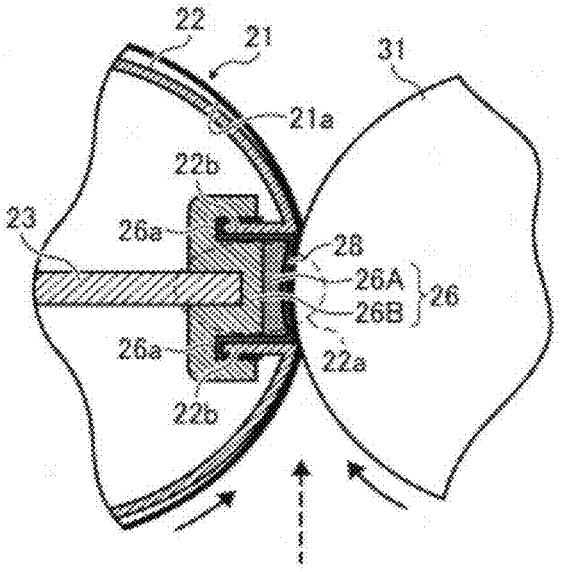
FIG. 7 is an enlarged view illustrating the vicinity of the fixing nip of a fixing device according to another embodiment of the present invention.

Although the fixed member 26 is made of only single material in this embodiment, it can be made of multiple types of material. Specifically, as shown in FIG. 7, the fixed member 26 can be constituted by a fixed main portion 26B (i.e., a rigid portion) made of heat-resistant resin, such as liquid crystal polymer, etc., and an elastic portion 26A made of elastic material, such as fluorine rubber, etc., disposed closer to a pressure roller 31 than the fixed main portion 26B. In such a situation, a surface of the elastic portion 26A of the fixed member 26 (i.e., a surface opposed to the pressure roller 31) is similarly formed in a desired shape, such as a concave, etc., as the fixed member 26 as described with reference to FIG. 4. Since the fixed member 26 is provided with the elastic portion 26A, and accordingly a toner image traces a fiber of a recording medium P and is uniformly heated even when the recording medium P fed has low smoothness (i.e., a recording medium having a rough surface), gloss irregularity (i.e., a so-called orange skin image) rarely occurs in an image after the fixing operation.

As described heretofore, according to one embodiment, a warm-up time period and a first printing time period can be minimized suppressing defective fixing even when a fixing device 20 (i.e., the image formation apparatus 1) becomes faster. Relatively the small number of parts is needed realizing good assembling performance. Limitations on a parts shape and a layout are relatively reduced. Further, deformation of the heater 22 due to spring back or the like can be minimized.

Further, in the fixing device 20 of this embodiment, the sheet 28 is provided between the endless fixing belt 21 and the fixed member 26. However, when a sliding resistance between the endless fixing belt 21 and the fixed member 26 is sufficiently decreased by providing the lubricant therebetween or applying low friction surface treatment such as fluorine resin coating, etc., onto a sliding contact surface of the fixed member 26, the sheet 28 can be omitted. Accordingly, in such a case, the bending portion 22*b* of the heater 22 directly fits into the groove 26*a* of the fixed member 26 without tucking both ends of the sheet 28. Even in such a situation, the similar effect of suppressing the spring back can be obtained as this embodiment.

Although the present invention is applied to the fixing device using a pressure roller 31 as a rotating member in this embodiment, it can be applied to another fixing device using a pressure endless belt as a rotating member and similar effect to that obtained in this embodiment can be obtained.

As an endless belt, although an endless fixing belt 21 of a multiple-layer structure is used in this embodiment of the present invention, an endless fixing film made of resin, such as polyimide, polyamide, fluorine resin, etc., or metal can be used and similar effect to that obtained in this embodiment can be obtained.

Further, as described above, this embodiment of the present invention is applied to a fixing device 20 employing a heating system with a heater 22, in which a heater is installed. However, the present invention can be applied to another fixing device employing an electromagnetic induction heating system using an excitation coil for heating a heater 22, (especially, a system in which an excitation coil is installed in the heater 22), or a fixing device using a resistance heating element for heating a heater 22 (especially, a system in which a resistance heating element is installed in the heater 22). Also in such a situation, similar effect to that obtained in this embodiment can be obtained again.

According to one embodiment of the present invention, a warm-up time and a first print time can be minimized, reducing defective fixing even with high-speed an image formation apparatuses. Further, only a relatively small number of parts is needed, thereby facilitating assembly. Further, limitations on parts shape and layout are eased, and deformation of the heater 22 due to spring-back or the like can be minimized.

Numerous additional modifications and variations of the present invention are possible in light of the above teachings. It is therefore to be understood that within the scope of the appended claims, the present invention may be practiced otherwise than as specifically described herein.

What is claimed is:

1. A fixing device comprising:

a flexible endless belt rotated in a prescribed direction to heat and fuse a toner image;

a rotating member disposed on an outer circumferential surface side of the flexible endless belt that presses against and rotates the flexible endless belt;

a fixed member mounted on the fixing device at both lateral ends and disposed on an inner circumferential surface side of the flexible endless belt to press against the rotating member via the flexible endless belt and form a nip through which a recording medium is conveyed;

a substantially cylindrical heater disposed facing an inner circumferential surface of the flexible endless belt to heat the flexible endless belt, the heater including an opening opposed to the rotating member, the opening accommodating the fixed member;

a reinforcing member disposed on an inner circumferential surface side of the heater to contact and reinforce the fixed member, wherein the fixed member holds an edge of the opening of the heater to prevent the heater from deforming, wherein the heater is a pipe having bent portions protruding from both lengthwise ends toward an interior of the pipe at the opening, wherein the fixed member includes a groove that accommodates the bent portions of the pipe;

a low-friction sheet held between the bent portions of the pipe and the groove of the fixed member; and a lubricant having a worked penetration of at least 300 degrees interposed between the low-friction sheet and the flexible endless belt.

2. The fixing device as claimed in claim 1, wherein the reinforcing member comprises a plate extending in the prescribed direction in which the rotating member presses against the flexible endless belt and fits into a concave portion formed in the fixed member, the reinforcing member having a length that is at least 80% of a diameter of the heater in the prescribed direction.

3. The fixing device as claimed in claim 1, wherein the reinforcing member is made of material having a Vickers hardness of at least 200 degrees.

4. The fixing device as claimed in claim 1, wherein the reinforcing member is made of ferritic stainless steel or ceramic.

5. The fixing device as claimed in claim 1, wherein the fixed member comprises:

a fixed body made of heat-resistant plastic; and an elastic portion made of elastic material located opposite the rotating member with respect to the fixed body.

6. An image formation apparatus including a fixing device, the fixing device comprising:

a flexible endless belt rotated in a prescribed direction to heat and fuse a toner image;

a rotating member disposed on an outer circumferential surface side of the endless belt that presses against and rotates the flexible endless belt;

a fixed member mounted on the fixing device at both lateral ends and disposed on an inner circumferential surface side of the flexible endless belt to press against the rotating member via the flexible endless belt and form a nip through which a recording medium is conveyed;

a substantially cylindrical heater disposed facing an inner circumferential surface of the flexible endless belt to heat the flexible endless belt, the heater including an opening opposed to the rotating member, the opening accommodating the fixed member;

a reinforcing member disposed on an inner circumferential surface side of the heater to contact and reinforce the fixed member, wherein the fixed member holds an edge of the opening of the heater to prevent the heater from deforming, wherein the heater is a pipe having bent portions protruding from both lengthwise ends toward an interior of the pipe at the opening, wherein the fixed member includes a groove that accommodates the bent portions of the pipe;

a low-friction sheet held between the bent portions of the pipe and the groove of the fixed member; and a lubricant having a worked penetration of at least 300 degrees interposed between the low-friction sheet and the endless belt.

7. The image formation apparatus as claimed in claim 6, wherein the reinforcing member comprises a plate extending in the prescribed direction in which the rotating member presses against the endless belt and fits into a concave portion formed in the fixed member, the reinforcing member having a length that is at least 80% of a diameter of the heater in the prescribed direction.

8. The image formation apparatus as claimed in claim 6, wherein the reinforcing member is made of material having a Vickers hardness of at least 200 degrees.

9. The image formation apparatus as claimed in claim 6, wherein the reinforcing member is made of ferritic stainless steel or ceramic.

10. The image formation apparatus as claimed in claim 6, wherein the fixed member comprises:

a fixed body made of heat-resistant plastic; and an elastic portion made of elastic material located opposite the rotating member.

11. A fixing device comprising:

a flexible endless belt rotated in a prescribed direction to heat and fuse a toner image;

a rotating member disposed on an outer circumferential surface side of the flexible endless belt that presses against and rotates the flexible endless belt;

a fixed member mounted on the fixing device at both lateral ends and disposed on an inner circumferential surface side of the flexible endless belt to press against the rotating member via the flexible endless belt and form a nip through which a recording medium is conveyed;

a substantially cylindrical heater disposed facing an inner circumferential surface of the flexible endless belt to heat the flexible endless belt, the heater including an opening opposed to the rotating member, the opening accommodating the fixed member; and a reinforcing member disposed on an inner circumferential surface side of the heater to contact and reinforce the fixed member, wherein the fixed member holds an edge of the opening of the heater to prevent the heater from deforming, and wherein the reinforcing member has a length that is at least 80% of a diameter of the heater in the prescribed direction.

12. The fixing device as claimed in claim 11, wherein the heater is a pipe having bent portions protruding from both lengthwise ends toward an interior of the pipe at the opening, wherein the fixed member includes a groove that accommodates the bent portions of the pipe.

13. The fixing device as claimed in claim 12, further comprising a low-friction sheet disposed between the flexible endless belt and the fixed member, wherein the low-friction sheet is held between the bent portions of the pipe and the groove of the fixed member.

14. The fixing device as claimed in claim 12, further comprising:

a low-friction sheet held between the bent portions of the pipe and the groove of the fixed member; and a lubricant having a worked penetration of at least 300 degrees interposed between the low-friction sheet and the flexible endless belt.

15. The fixing device as claimed in claim 11, wherein the reinforcing member comprises a plate extending in the prescribed direction in which the rotating member presses against the flexible endless belt and fits into a concave portion formed in the fixed member.

16. The fixing device as claimed in claim 11, wherein the reinforcing member is made of material having a Vickers hardness of at least 200 degrees.

17. The fixing device as claimed in claim 11, wherein the reinforcing member is made of ferritic stainless steel or ceramic.

18. The fixing device as claimed in claim 11, wherein the fixed member comprises:

a fixed body made of heat-resistant plastic; and an elastic portion made of elastic material located opposite the rotating member with respect to the fixed body.

19. An image formation apparatus including a fixing device, the fixing device comprising:

a flexible endless belt rotated in a prescribed direction to heat and fuse a toner image; a rotating member disposed on an outer circumferential surface side of the endless belt that presses against and rotates the flexible endless belt;

a fixed member mounted on the fixing device at both lateral ends and disposed on an inner circumferential surface side of the flexible endless belt to press against the rotating member via the flexible endless belt and form a nip through which a recording medium is conveyed;

a substantially cylindrical heater disposed facing an inner circumferential surface of the flexible endless belt to heat the flexible endless belt, the heater including an opening opposed to the rotating member, the opening accommodating the fixed member; and a reinforcing member disposed on an inner circumferential surface side of the heater to contact and reinforce the fixed member, wherein the fixed member holds an edge of the opening of the heater to prevent the heater from deforming, and wherein the reinforcing member has a length that is at least 80% of a diameter of the heater in the prescribed direction.

20. The image formation apparatus as claimed in claim 19, wherein the heater is a pipe having bent portions protruding from both lengthwise ends toward an interior of the pipe at the opening, wherein the fixed member includes a groove that accommodates the bent portions of the pipe.

21. The image formation apparatus as claimed in claim 20, further comprising a low-friction sheet disposed between the endless belt and the fixed member, wherein the low-friction sheet is held between the bent portions of the pipe and the groove of the fixed member.

22. The image formation apparatus as claimed in claim 19, wherein the reinforcing member comprises a plate extending in the prescribed direction in which the rotating member presses against the endless belt and fits into a concave portion formed in the fixed member.

23. The image formation apparatus as claimed in claim 19, wherein the reinforcing member is made of material having a Vickers hardness of at least 200 degrees.

24. The image formation apparatus as claimed in claim 19, wherein the reinforcing member is made of ferritic stainless steel or ceramic.

25. The image formation apparatus as claimed in claim 19, wherein the fixed member comprises:

a fixed body made of heat-resistant plastic; and an elastic portion made of elastic material located opposite the rotating member.

* * * * *